United States Patent [19]

Patrick

[11] Patent Number: 4,818,971

[45] Date of Patent: Apr. 4, 1989

[54] FALSE ALARM RESISTANT BURGLAR ALARM SYSTEM

[76] Inventor: Robert H. Patrick, 1578 St. Mary's Road, Winnipeg, Manitoba, Canada, R2M 3W4

[21] Appl. No.: 160,253

[22] Filed: Feb. 25, 1988

[51] Int. Cl.[4] ..... G08B 13/00

[52] U.S. Cl. ..... 340/543; 70/434

[58] Field of Search ..... 340/542, 543; 70/434; 200/61.67, 61.68

[56] References Cited

U.S. PATENT DOCUMENTS

| | | | |
|---|---|---|---|
| 1,112,316 | 9/1914 | Percival . | |
| 1,388,119 | 8/1921 | Pehel | 200/61.64 X |
| 2,057,301 | 10/1936 | Golokow et al. | 200/61.66 |
| 3,537,094 | 10/1970 | Hawkins et al. | 200/61.64 X |
| 3,596,014 | 7/1971 | Erez | 200/61.66 X |
| 3,685,036 | 8/1972 | Torok | 200/61.66 X |
| 3,857,001 | 12/1974 | Quantz | 200/61.64 |
| 3,866,164 | 2/1975 | Peterson | 200/61.64 X |
| 3,877,266 | 4/1975 | McLaughlin | 340/542 X |
| 3,890,608 | 6/1975 | Peterson | 200/61.64 X |
| 3,939,315 | 2/1976 | Schlage | 200/61.64 |
| 3,969,584 | 7/1976 | Miller et al. | 340/542 X |

*Primary Examiner*—Jerry W. Myracle

*Attorney, Agent, or Firm*—Murray E. Thrift; Stanley G. Ade; Adrian D. Battison

[57] ABSTRACT

A door lock includes circuitry for signalling the condition and operation of the lock. The lock has a bolt and two separate locking mechanisms, each operable to lock the bolt in its projected position. A bolt position signal switch generates a signal indicating the position of the bolt, either projected or retracted. Two lock signal switches are operated by the respective locking mechanisms to provide respective lock position signals. An intruder alarm using the lock includes a perimeter alarm subsystem, an interior alarm subsystem and an alarm conditioning control. The control is responsive to an unlocked condition of the door as signalled by the bolt position signal to disable both the perimeter and the interior alarm subsystems. When the door is locked from outside the premises protected, the control activates the perimeter and interior alarms, while locking of the door lock from inside locks the perimeter alarm only.

19 Claims, 2 Drawing Sheets

FALSE ALARM RESISTANT BURGLAR ALARM SYSTEM

FIELD OF THE INVENTION

The present invention relates to alarm systems, and more particularly to alarm systems for detecting unauthorized intrusion into protected premises and a door lock component of such a system.

BACKGROUND

Intruder alarm systems have become increasingly popular for domestic as well as business use. There are various different systems available on the market today. These include perimeter alarm systems, which are used to monitor the perimeter of a protected premise and to detect an unauthorized entry into the premise through the monitored perimeter. Interior alarm systems include such things as motion and sound detectors that are activated by motions, sounds, or other predetermined activity within a supposedly empty premise.

While such systems operate well, a significant detracting factor is the need to arm and disarm the system when entering or leaving. Thus, with a domestic alarm system fitted with both perimeter and interior alarms, the occupant usually has a limited time, say a few seconds, on entering the premise to reach a keypad and enter a predetermined code to prevent a false alarm signal. Once the occupant is in the premise and has locked the door from the inside, the perimeter alarm system must be reactivated, again using the keypad. When leaving, the alarm is conditioned using the keypad, leaving a limited amount of time to leave the premise and lock the door from the outside.

While this procedure works, it is cumbersome and it does result in a large number of false alarms.

The present invention aims at the provision of an alarm system and a locking mechanism therefore that avoids these difficulties.

SUMMARY

According to one aspect of the present invention there is provided an intruder alarm system for a premise having an entry door with a door lock, said alarm including a perimeter alarm subsystem actuated by an unauthorized entry into the premise, an interior alarm subsystem actuated by predetermined occurrences within the premise and alarm conditioning means comprising means responsive to an unlocked condition of the door lock to disable both the perimeter alarm and interior alarm subsystems, means responsive to locking of the door lock from outside the premise to activate the perimeter and interior alarm subsystem, and means responsive to locking of the door lock from inside the premise to activate the perimeter alarm subsystem only.

With this system, the alarm conditioning is responsive completely to the operation of the conventional door lock. Thus, when an occupant of a premise with both perimeter and interior alarm systems opens the door from the outside, both systems are deactivated by unlocking the outer lock with the proper key. When the bolt is drawn, this latches the alarm system in an inactive state. When the doors close and lock from the inside, the perimeter alarm alone is reset by the action of locking the door. On the other hand, when leaving the premise, the perimeter alarm is deactivated when the door is unlocked and both the perimeter and interior alarms are reset when the door is relocked from the outside. Thus, from the point of view of the user, there is no additional manipulation to be carried out other than the usual unlocking and locking of the door to the premise.

According to another aspect of the present invention, there is provided a door lock with means for signaling the condition and operation of the lock, said lock comprising:

a bolt with projected and retracted positions;

first and second bolt locking means, each operable to lock the bolt in the projected position;

a bolt position signal means, operable in response to the bolt being in one of the projected and retracted positions to provide a bolt position signal; and first and second lock signal means responsive to operation of the first and second locking means respectively to provide respective first and second lock condition signals.

A lock of this type is capable of performing the necessary alarm conditioning functions of the system described above. When the lock is manufactured as a twin cylinder lock with integral switches, it may be installed readily and inobtrusively. A logic circuit receiving signals from the lock interprets those signals to set the alarm to the desired condition.

BRIEF DESCRIPTION OF THE DRAWINGS

In the accompanying drawings, which illustrate an exemplary embodiment of the present invention.

DETAILED DESCRIPTION

Figure 1:
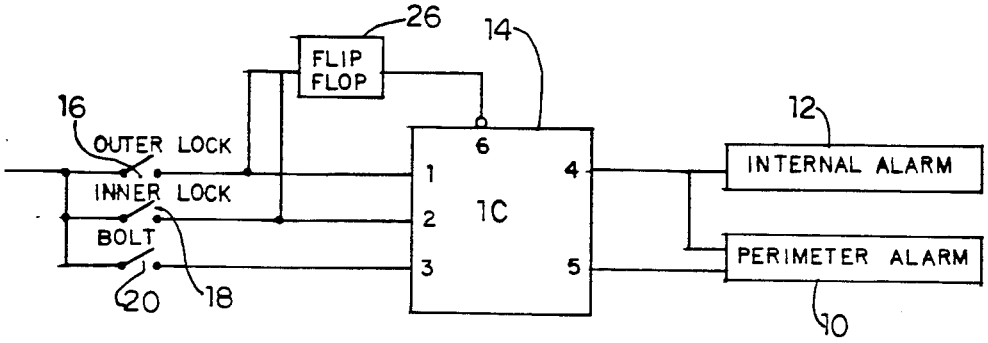
FIG. 1 is schematic representation of an alarm system according to the present invention.

Referring to the accompanying drawings, and especially to FIG. 1, there is illustrated an alarm system that includes a perimeter alarm 10 and an internal alarm 12, both of which are illustrated schematically. Both subsystems are connected to an output 4 of an integrated logic circuit 14. The perimeter alarm 10 is also connected to an output 5 of the circuit 14. The logic circuit as illustrated has three inputs, labeled 1, 2, and 3 respectively. Input 1 is connected to an outer lock switch 16, input 2 is connected to an inner lock 18 and input 3 is connected to a bolt switch 20. In addition, the outer and inner lock switches 16 and 18 are connected to a flipflop 26 that is in turn connected to the chip enable input 6 of the circuit 14.

The circuit 14 remains static until enabled by the output from flipflop 26 at terminal 6. A change in the output 4 of circuit 14 requires two high inputs at terminals 1 and 3 and one enabling signal from flipflop 26. Similarly, a change in the output at terminal 5 requires two high inputs at terminals 2 and 3 and an enabling signal from the flipflop.

Assuming a low output at output terminal 4 and a high output at terminal 5 of circuit 14, enabling both the perimeter alarm and the internal alarm 12, closing the switch 16 will reset the flipflop 26 and enable the circuit 14. The output at terminal 4 will change when the bolt is drawn and switch 20 is also closed, providing high inputs at terminals 1 and 3. This provides a high signal at output 4 of circuit 14, disabling the alarms 10 and 12. The output of closed switch 20 is used to latch this condition despite the opening of outer lock switch 16. If the inner lock switch 18 is then closed, the flipflop is again actuated, enabling the circuit 14. Because of the presence of two high signals at terminals 2 and 3, a low output is produced at output terminal 5 activating the perimeter alarm 10. Opening the bolt switch 20 and then inner lock switch 18 will remove the high inputs at terminals 2 and 3, leaving the output of terminal 5 low and the perimeter alarm 10 active.

The reverse operation, closing switch 18, closing switch 20, opening switch 18, closing switch 16, opening switch 20 and then opening switch 16 will deactivate the perimeter alarm and reactivate the combination of internal and perimeter alarms.

Figure 2:
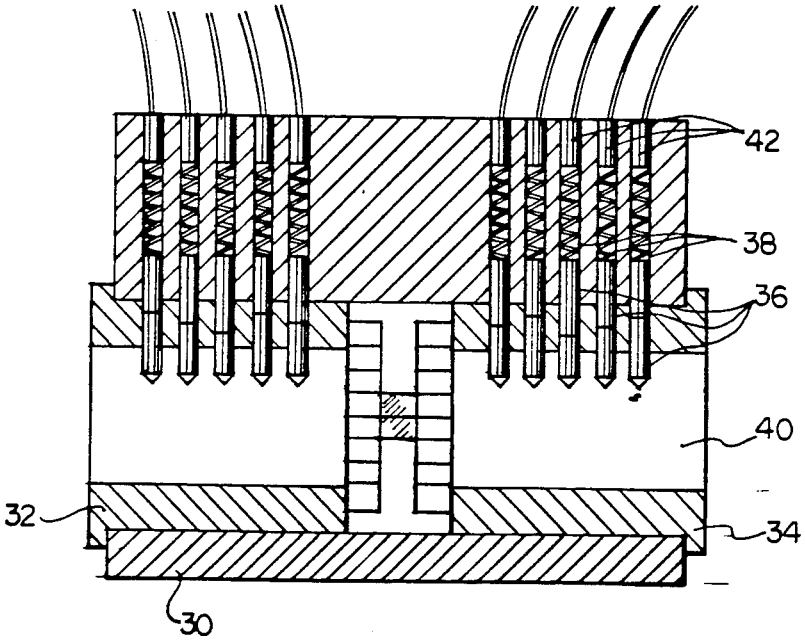
FIG. 2 is a sectional view of a lock suitable for use in the alarm system of FIG. 1.

Referring to FIG. 2, there is illustrated a twin cylinder lock suitable for use in the present invention. The lock comprises a lock body 30 carrying two lock cylinders 32 and 34 arranged end to end and locked to the body by conventional pin tumbler systems including two-part pins 36, springs 38 biasing the pins into a key slot 40, and plugs 42 retaining the springs and pins in place. In the present lock, the plugs 42 are switch components actuated in response to the insertion of the proper key into the keyhole 40. The switches may be of the type described in U.S. Pat. No. 2,057,301, or they may be any other device suitable for generating an electric signal when the proper key is inserted. In the illustrated lock, all of the plugs 42 are switches. For the purposes of the present invention, a lock with a single switch for each cylinder is adequate for a single entry door.

Figure 3:
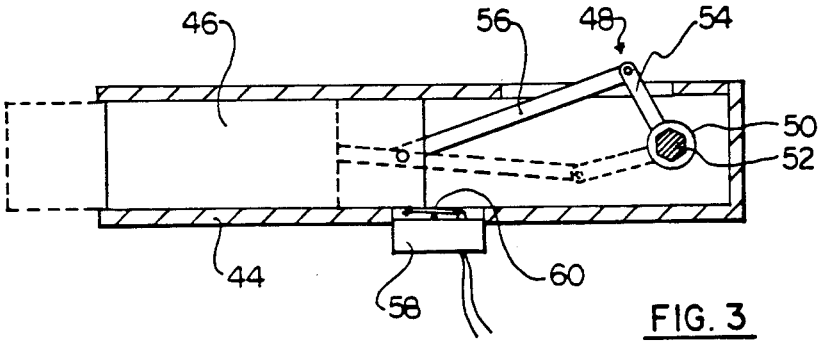
FIG. 3 is a sectional view of a bolt mechanism for use with the lock of FIG. 2.

FIG. 3 illustrates a bolt mechanism for use with the lock. This includes a cylinder 44 carrying a sliding bolt 46 driven by a linkage 48. The linkage includes a collar 50 fitted on an hexagonal shaft 52 that extends between the two lock cylinders 32 and 34 and which may be rotated independently by each cylinder in the known way. An arm 54 connected to the sleeve 50 has its outermost end connected to a link 56 which is in turn pinned to the bolt 46. The arrangement is such that rotation of the shaft 52 rotates the arm 54 towards the bolt, so that the link 56 projects the leading end of the bolt 46 from the end of the sleeve 44. A switch 58 is mounted on the sleeve 44 and has an operating lever 60 that projects into the sleeve to engage the bolt 46 when it is retracted. This actuates the switch 58 to provide a signal of a retracted bolt condition. When the bolt is projected, the switch lever 60 is released and the condition switch indicates a projected bolt.

Figure 4:
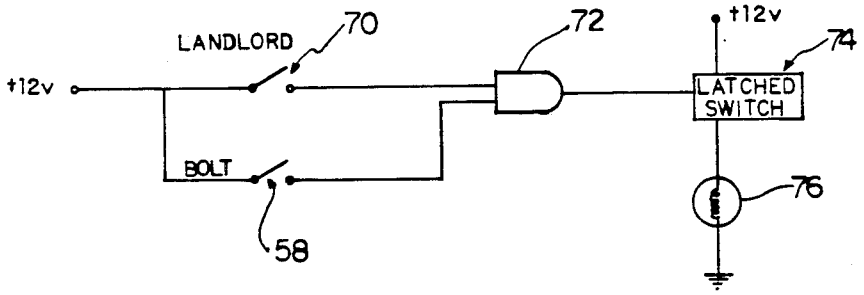
FIG. 4 is a schematic representation of an optional subsystem.

FIG. 4 of the drawings illustrates an additional circuit that may be used where it is desired to have an indication that premises have been entered using a particular key. This may, for example, be in rented premises, where a landlord requires access to the premises. In such circumstances, the landlord's key may be arranged to activate a switch 70 in the lock that is not normally activated by the usual entry key. Closure of that switch, in conjunction with closure of the bolt switch 58 provide signals to and circuit 72 which in turn operates a latched switch 74 for illuminating a light 76.

It is also possible to use the signal from a switch such as switch 70 to override the alarm disabling circuit and produce an alarm where the special key is used improperly, for example, during unauthorized hours. This could be achieved through the use of a timer circuit connecting the switch 70 to the alarm.

Where a premise has more than one entry door, a multiple switch lock such as that illustrated in FIG. 2, may be used on each door. The logic circuit may then be connected to different switches of the different locks, in order to discriminate between doors. The information thus collected may be used for any desired control function, or for recording purposes.

While certain embodiments of the invention have been described in the foregoing, it is to be understood that other embodiments are possible within the scope of the present invention. For example, the various switches described in the foregoing may be any appropriate signal device capable of producing a signal representing the state of a lock or bolt. The invention is to be considered limited solely by the scope of the appended claims.

I claim:

1. A door lock with means for signaling the condition and operation of the lock, said lock comprising:
   - a bolt with projected and retracted positions;
   - first and second bolt locking means, each operable to lock the bolt in the projected position;
   - a bolt position signal means, operable in response to the bolt being in one of the projected and retracted positions to provide a bolt position signal; and
   - first and second lock signal means responsive to operation of the first and second locking means respectively to provide respective first and second lock condition signals.

2. A lock according to claim 1 wherein the first and second bolt locking means comprise respective cylinders of a twin cylinder lock.

3. A lock according to claim 2 wherein each cylinder of the lock includes a tumbler-operated switch.

4. A lock according to claim 2 wherein each cylinder of the lock includes a plurality of tumbler-operated switches.

5. A lock according to claim 1 including logic circuit means connected to the signal means and operable to generate alarm control signals in response to signals from the signal means.

6. A lock according to claim 5 wherein the logic circuit means includes means responsive to a bolt position signal representing the retracted position of the bolt to generate an alarm disabling signal.

7. A lock according to claim 6 wherein the logic circuit means includes means responsive to the unlocking of either locking means to generate an alarm disabling signal.

8. An intruder alarm system for a premise having an entry door with a door lock, said alarm including a perimeter alarm subsystem actuated by an unauthorized entry into the premise, an interior alarm subsystem actuated by predetermined occurrences within the premise and alarm conditioning means comprising means responsive to an unlocked condition of the door lock to disable both the perimeter alarm and interior alarm subsystems, means responsive to locking of the door lock from outside the premise to activate the perimeter and interior alarm subsystem, and means responsive to locking of the door lock from inside the premise to activate the perimeter alarm subsystem only.

9. An alarm system according to claim 8 wherein the alarm conditioning means comprise a plurality of signal means operatively associated with said door lock and circuit means responsive to the signaling means to condition the alarm system.

10. An alarm system according to claim 9 wherein the door lock includes a bolt with projected and retracted positions, first bolt locking means for locking the bolt from outside the premise and second bolt locking means for locking the bolt from inside the premise, said signal means comprising a bolt signal means operable in response to the bolt being in one of the projected and retracted positions to provide a bolt position signal and first and second lock signal means responsive to operation of the first and second locking means to provide respective first and second lock condition signals.

11. A lock according to claim 10 wherein the first and second bolt locking means comprise respective cylinders of a twin cylinder lock.

12. An alarm system according to claim 11 wherein each cylinder of the lock includes a tumbler operated switch.

13. An alarm system according to claim 11 wherein each cylinder of the lock includes a plurality of tumbler operated switches.

14. An alarm system according to claim 13 wherein the premise includes a plurality of entry doors, each with a door lock comprising a bolt and first and second lock cylinders for locking the bolt, the alarm system including a plurality of switches associated with each lock cylinder and logic means responsive to the operation of at least one switch from each said lock for conditioning the alarm system.

15. An alarm system according to claim 10 including logic circuit means connected to the signal means and responsive to signals generated thereby to generate alarm control signals.

16. An alarm system according to claim 5 wherein the logic circuit means includes means responsive to a first lock condition signal representing a unlocked condition of the first bolt locking means and a bolt position signal representing the retracted position of the bolt to generate a signal disabling the perimeter alarm subsystems.

17. An alarm system according to claim 16 wherein the logic circuit includes means responsive to a second lock condition signal representing an unlocked condition of the second bolt locking means and bolt position signal representing the retracted position of the bolt to generate an alarm disabling signal, disabling the perimeter alarm subsystem.

18. An alarm system according to claim 10 wherein the first locking means includes a further lock signaling means responsive to unlocking of the first locking means with a selected key to generate an entry signal.

19. An alarm system according to claim 18 including means for maintaining the entry signal regardless of the position of the bolt or the condition of the first and second bolt locking means.

* * * * *